United States Patent [19]

Nissenbaum

[11] Patent Number: 4,516,336

[45] Date of Patent: May 14, 1985

[54] PROTECTIVE OVERSHOE

[76] Inventor: Judith Nissenbaum, 20 Fifth Ave., New York, N.Y. 10001

[21] Appl. No.: 531,664

[22] Filed: Sep. 13, 1983

[51] Int. Cl.[3] ..... A43B 3/16; A43B 3/24

[52] U.S. Cl. ..... 36/7.1 R; 36/7.3; 36/8.1

[58] Field of Search ..... 36/7.1 R, 7.1 A, 8.1, 36/88, 91, 7.2, 7.3

[56] References Cited

U.S. PATENT DOCUMENTS

| | | | |
|---|---|---|---|
| 4,497 | 5/1846 | Vetter | 36/7.1 R |
| 1,312,781 | 8/1919 | Flannery | 36/7.1 R |
| 2,142,981 | 1/1939 | Richards | 36/7.1 A |
| 2,229,575 | 1/1941 | Kaplan | 36/7.1 R |
| 3,319,360 | 5/1967 | Nadler | 36/7.3 |
| 4,023,281 | 5/1977 | Terry | 36/7.1 R |

FOREIGN PATENT DOCUMENTS

| | | | |
|---|---|---|---|
| 128530 | 1/1932 | Austria | 36/8.1 |
| 2236435 | 3/1975 | France | 36/7.1 R |
| 3384 | 7/1883 | United Kingdom | 36/7.1 R |

*Primary Examiner*—Werner H. Schroeder
*Assistant Examiner*—Steven N. Meyers
*Attorney, Agent, or Firm*—McAulay, Fields, Fisher, Goldstein & Nissen

[57] ABSTRACT

This disclosure is directed to a protective overshoe that is waterproof or water-resistant to afford protection to a variety of footwear. A plurality of elastic bands are positioned along different portions of the overshoe to properly position the overshoe on the wearer's leg and over the wearer's shoe or boot. The heel and sole portions are separated by an arch portion to facilitate folding of the heel and sole portions relative to each other, whereby the overshoe may be collapsed and folded for carrying or storage in a pouch.

15 Claims, 12 Drawing Figures

PROTECTIVE OVERSHOE

BACKGROUND OF THE INVENTION

This invention is directed to a protective overshoe, and more specifically, to a collapsible waterproof or water-resistant overshoe which will afford protection to all types of footwear when in use, and which may be easily folded and carried in a storage pouch when in a collapsed condition.

Heretofore, it is known to wear galoshes or slush-boots to protect a shoe from inclement weather, such as rain or snow. Although these overshoes perform their intended function, they are not stylish and are not readily collapsible to fit easily into a purse or attache case. Also, they must be manufactured in many sizes to accommodate the shoe size of the wearer, and they cover only the foot portion or foot and ankle portions of the shoe. Neither warmth nor protection is afforded to the leg of the wearer, nor is protection afforded to a tall boot. Many of the known protective shoe coverings also are made to fit either a right foot or a left foot, and thus are not interchangeable.

It also is known that the wearer will replace a fashionable leather boot in inclement weather with a rubber or plastic molded boot. Although these molded boots try to simulate the appearance of stylish leather boots, they have not acquired the fashion aesthetic of leather. They can become heavy and uncomfortable to wear for long periods of time, and are not collapsible for compact carrying or storage. Thay also must be manufactured in a wide range of sizes so as to accomodate the size of the wearer's foot, and are only made to fit either a right foot or left foot.

The present invention provides a novel and unique protective overshoe which overcomes many of the disadvantages associated with the heretofore known galoshes and plastic molded boots.

SUMMARY

The protective overshoe of this invention is made of a collapsible sheet material formed having a foot encasing portion and a leg encasing portion. The foot encasing portion has an instep portion, a heel portion, a sole portion and an arch portion. The heel and sole portions are separated by the arch portion, and are reinforced by separate heel and sole members to provide durable walking surfaces.

An elastic band extends around the arch portion and the instep portion to render the overshoe adjustable to accomodate various shoe sizes and shapes, and various heel heights. A second elastic band encircles the top edge of the leg encasing portion to snugly grip the leg of the wearer and reduce the likelihood of water being received or collected in the space between the overshoe and the wearer's leg. A third elastic band encircles the ankle zone to facilitate ready passage of the wearer's foot, and maintain proper placement of the foot encasing and leg encasing portions relative to each other on the wearer's leg. A plurality of additional elastic members encircle the leg encasing portion at spaced intervals along its length to provide snug support of the overshoe on the wearer's leg.

The arrangement is such that the overshoe will accomodate a wide variety of shoe sizes and shapes and heel heights, and may be collapsed and folded, when not in use, for carrying or storage in a pouch. The overshoe is constructed to be waterproof or water-resistant, and is universal in its utility in that one pattern can fit either the right or left foot.

For a better understanding of the invention, and its various features and advantages, reference should be made to the following detailed description when taken in conjunction with the accompanying drawings.

DESCRIPTION OF THE PREFERRED EMBODIMENT

Figure 1:
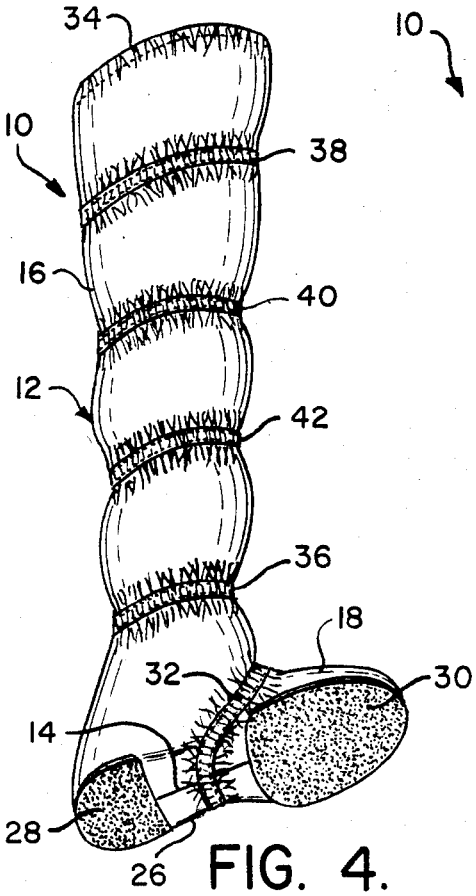
FIG. 1 is a perspective view of a protective overshoe embodying the present invention, looking from the bottom, and showing the heel and sole portions separated by an arch portion.
Figure 2:
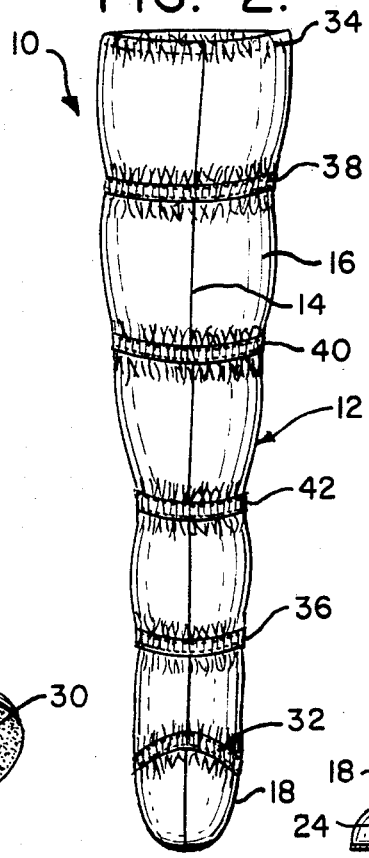
FIG. 2 is a front elevational view of the protective overshoe of FIG. 1.
Figure 3:
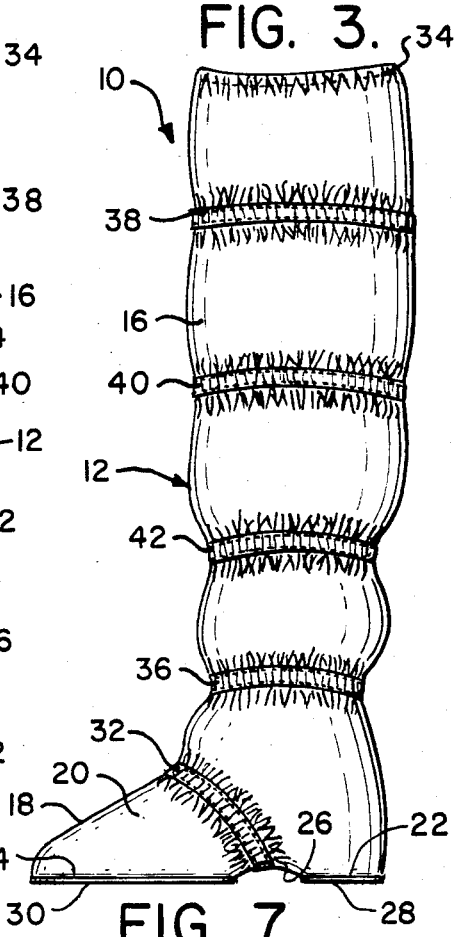
FIG. 3 is a left side elevational view of the protective overshoe of FIG. 1.
Figure 4:
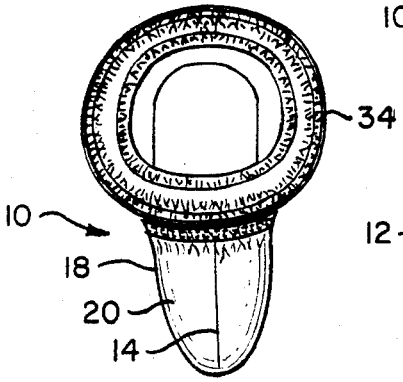
FIG. 4 is a top plan view of the protective overshoe of FIG. 1.

Referring to the drawings, and more particularly to FIGS. 1–7, there is shown a protective overshoe constructed in accordance with the present invention. Overshoe 10 includes a body member 12 formed of a collapsible substantially continuous waterproof of water-resistant sheet material. The material may be fabric having a plastic coating, such as nylon, or made entirely of a plastic composition. Body member 12 may be formed of one-seam construction, as shown by seam line 14, or of multiple-seam construction, as desired.

Body member 12 further is formed having a leg encasing portion 16 and a foot encasing portion 18. The foot encasing portion 18 is constructed having an instep portion 20, a heel portion 22, a sole portion 24 and an arch portion 26. The heel portion 22 and the sole portion 24 are separated by the arch portion 26. A separate heel member 28 is suitably secured to heel portion 22 and a separate sole member 30 is similarly secured to sole portion 24. The manner of attachment may take the form of adhesive or stitching, or the like.

Figure 5:
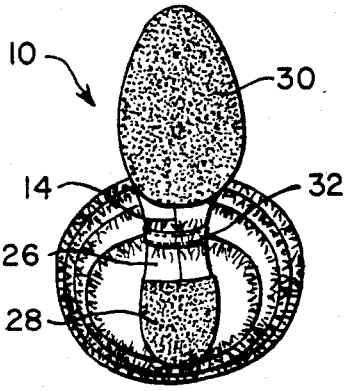
FIG. 5 is a bottom plan view of the protective overshoe of FIG. 1.
Figure 6:
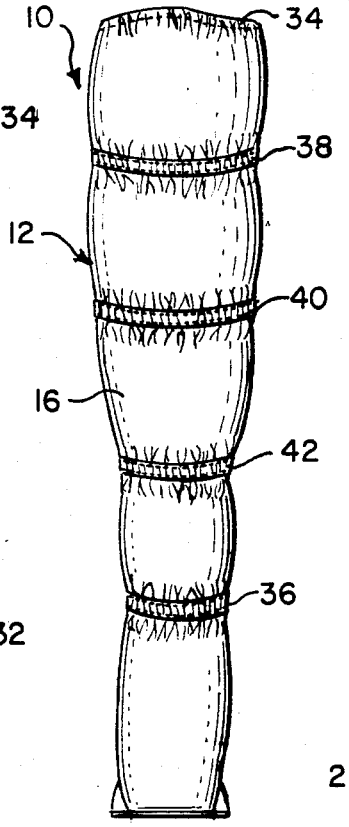
FIG. 6 is a rear elevational view of the protective overshoe of FIG. 1.
Figure 7:
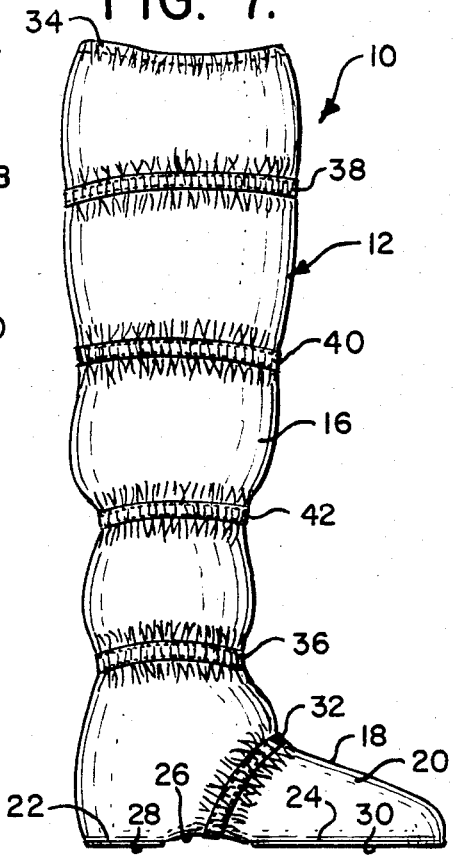
FIG. 7 is a right side elevational view of the protective overshoe of FIG. 1.
Figure 8:
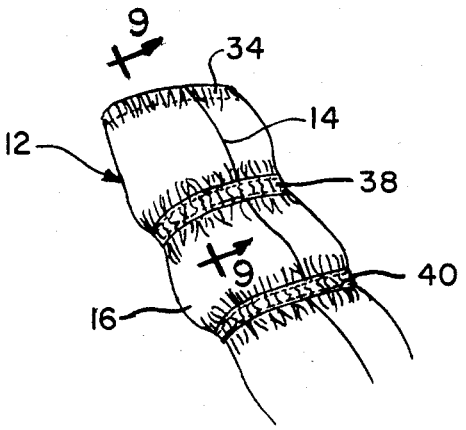
FIG. 8 is a partial perspective view of the upper portion of the protective overshoe of FIG. 2.
Figure 10:
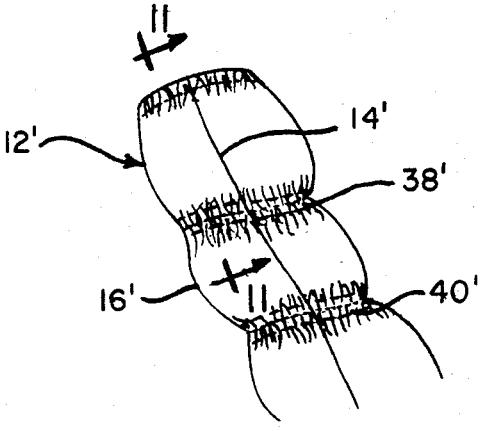
FIG. 10 is a view similar to FIG. 8 showing another embodiment of the protective overshoe invention.

Heel member 28 and sole member 30 constitute reinforcement members to provide a durable walking surface. They may be formed of rubber or plastic having ribbed or roughened walking surfaces, as shown in FIGS. 1 and 5, and are dimensioned to be no greater than approximately $\frac{1}{8}$ inch (0.32 cm) thick. Alternatively, in certain instances, it may be preferable merely to thicken or otherwise reinforce the heel and sole portions 22, 24 without securing thereto separate heel and sole members 28, 30. The ribbed walking surfaces may be tread-like or formed having various geometric patterns or configurations.

The heel and sole portions 22, 24, either having the associated heel and sole members 28, 30 or otherwise reinforced to constitute the walking surfaces, are relatively non-collapsible compared to the collapsibility of body member 12. As such, said heel and sole portions 22, 24 are foldable relative to each other by appropriately collapsing the instep portion 20 and arch portion 26. For example, arch portion 26 may be collapsed so that heel and sole portions 22, 24 overlie each other. The overshoe then may be rolled upwardly in a collapsed state and folded to overall length and width dimensions only slightly greater than the length and width dimensions of sole portion 24.

An elastic band 32 is secured to foot encasing portion 18 by stitching, or the like, and extends around the instep portion 20 and arch portion 26 to provide an adjustability of the overshoe for various shoe sizes and shapes, and various heel heights of the wearer's shoe. This eliminates the need to have a separately sized overshoe for each shoe size. Rather, it is envisioned that one size overshoe will accomodate different size shoes or boots within a given rage of sizes. Thus, it is expected that the overshoe can be made in sizes representative of small, medium and large to accomodate virtually the entire range of shoe and boot sizes.

Furthermore, it is within the scope of the invention to provide an overshoe that may be worn either on the right foot or left foot. To this end, the overshoe may be regarded as being neutral or universal in the sense that one pattern design fits either foot.

A second elastic band 34 is similarly secured to body member 12 and encircles the top of leg encasing portion 16 to snugly support body member 12 on the leg of a wearer. This serves to keep the leg encasing portion properly positioned on the wearer's boot, and also reduces the likelihood of water, snow or dirt accumulating or being caught between the inner surface of the overshoe and the wearer's leg or boot. It also will be appreciated that bands 38–42 permit overshoe 10 to adapt itself to varied leg dimensions and varied boot or shoe sizes of differently apportioned wearers. The bands also enable the overshoe to accomodate many different styles of footwear.

Figure 9:
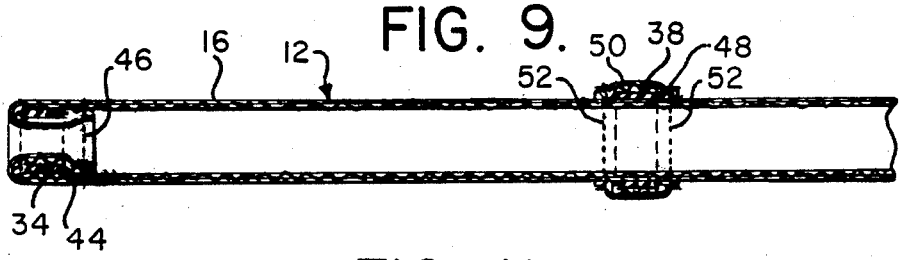
FIG. 9 is a cross-sectional view taken along line 9—9 of FIG. 8.
Figure 11:
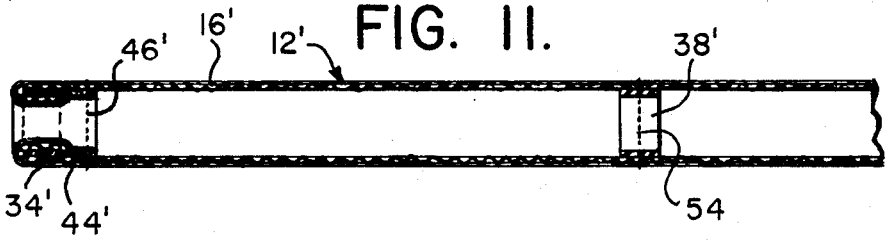
FIG. 11 is a cross-sectional view taken along line 11—11 of FIG. 10.

FIGS. 8–11 show different ways in which the elastic bands may be secured to the overshoe. More specifically, FIG. 9 illustrates an embodiment in which each of the bands is received in a separate channel. For example, the top edge of leg encasing portion 16 is folded-over inwardly to form a pocket or channel 44 in which is positioned band 34. The channel 44 is closed by means of stitching 46, or the like.

Each of the remaining channels 48 representative of this embodiment is formed on body member 12 by means of a separate strip 50 encircling the outer surface of member 12. Thus, for example, the elastic band represented by number 38 in FIG. 9 is positioned between strip 50 and the outer surface of body member 12 whereupon strip 50 is secured in place by means of stitching 52, or the like.

A third elastic band 36 is secured to body member 12 and encircles the ankle zone to permit ready passage of the wearer's foot to and from foot encasing portion 18. This serves to secure and maintain the proper placement of leg encasing portion 16 and foot encasing portion 18 relative to each other on the wearer's shoe or boot. In other words, elastic band 36 first stretches or expands to permit the wearer's foot to enter the foot receiving portion 18 whereupon band 36 contracts to snugly fit around the wearer's ankle. This keeps the foot encasing portion 18 properly positioned on the wearer's foot regardless of whether or not leg encasing portion 16 is fully extended or rolled down in a collapsed state.

Between elastic band 34 and elastic band 36, there is provided a plurality of additional elastic bands 38, 40 and 42 secured to and encircling leg encasing portion 16. These bands are spaced along the length of leg encasing portion 16 and provide snug support against the wearer's leg or footwear, and permit ready dressing and removal of the overshoe by the wearer. Bands 38–42 also keep the overshoe properly positioned even if the top of leg encasing portion 16 is partially rolled down.

Figure 12:
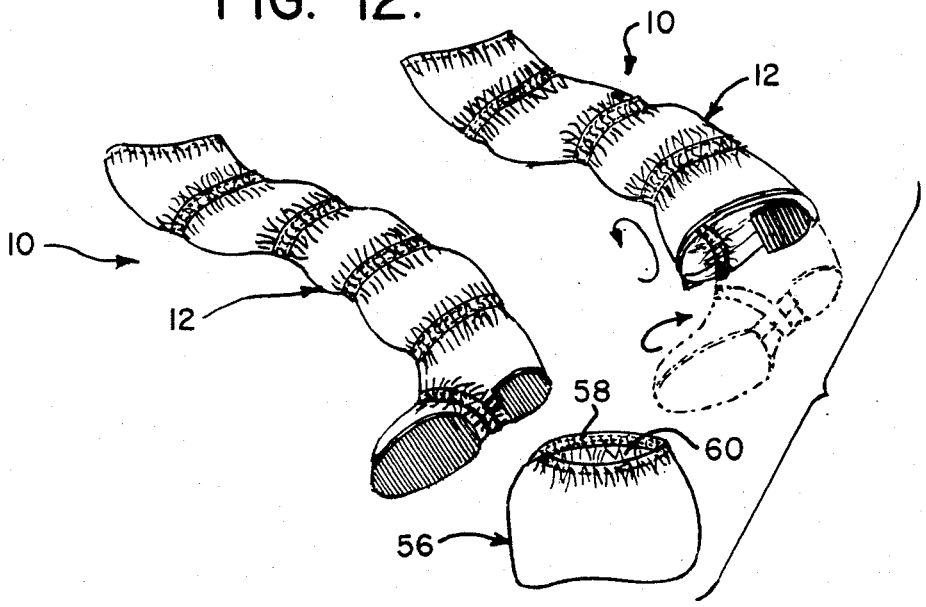
FIG. 12 is a perspective view of a pair of boots, one in the process of being folded to be received in a storage pouch.

In order to facilitate carrying and/or storage of the overshoe, a pouch 56 is provided, as shown in FIG. 12, whereby a pair of overshoes 10 may be stored in a collapsed state. Pouch 56 is made of the same material as the overshoe 10 and is formed with an elastic band 58 encircling the opening 60 to retain the overshoes therein. As will be appreciated, opening 60 is stretched open to receive the overshoes 10 in a collapsed state. Furthermore, in place of elastic band 58, other forms of closures may be used, such as snaps, zippers, or the like. As shown, the sole portion of one of the overshoes has been folded over relative to the heel portion, and the overshoe is in the process of being rolled-up for insertion into pouch 56 when fully collapsed. Pouch 56 is suitably dimensioned to receive two of the overshoes therein in a collapsed condition.

Accordingly, there is provided a unique protective overshoe that is lightweight and easy to use. It affords protection to all footwear including costly leather boots. The overshoe provides a snug enclosure of the wearer's foot and lower leg portion, and is compatable for use with shoes and boots having various heel heights. The overshoe is neutral in the sense that it may be interchangably worn by men or women on either foot, and be manufactured in two or three standard sizes to adequately cover virtually the entire spectrum of shoe sizes. The overshoe is constructed to be waterproof or water-resistant, and may be easily collapsed to fit into a carrying or storage pouch.

While the present invention has been described with respect to particular embodiments, it will be readily appreciated and understood that numerous variations and modification thereof may be made without departing from the spirit or scope of the claimed invention.

I claim:

1. A protective overshoe comprising:

a body member formed of a collapsible sheet material, said body member having a leg encasing portion and a foot encasing portion;

said foot encasing portion having an instep portion, a heel portion, a sole portion and an arch portion, said heel and sole portions being separated by said arch portion;

first reinforcement means on said heel portion and second reinforcement means on said sole portion to provide durable walking surfaces, said first and second reinforcement means being relatively non-collapsible compared to said body member and being spaced from one another by said arch portion, said first and second reinforcement means being foldable relative to each other by appropriately collapsing said arch and instep portions; and a band member engaging and extending around said arch portion and said instep portion, said band member engaging said arch portion at a location spaced forwardly from the front edge of said first reinforcement means on said heel portion and being spaced rearwardly from the rear edge of said second reinforcement means on said sole portion, said band member providing adjustability across said arch and instep portions for various shoe sizes and shapes and for various heel heights;

whereby said overshoe will accommodate a wide variety of shoe sizes and shapes and heel heights, and whereby said overshoe may be collapsed and folded to length and width dimensions only slightly greater than the length and width dimensions of said sole portion.

2. The overshoe of claim 1, further comprising a second band member encircling the top of said leg encasing portion to snugly support said collapsible body member on the leg of a wearer.

3. The overshoe of claim 2, further comprising a third band member encircling the ankle zone of said collapsible body member to permit ready passage of the foot of the wearer to and from the foot encasing portion of said body member.

4. The overshoe of claim 3, further comprising a plurality of band members encircling the leg encasing portion of said collapsible body member to provide snug support for said leg encasing portion on the leg of the wearer, and to permit ready dressing and removal of the overshoe by the wearer.

5. The overshoe of claim 4, further comprising a plurality of channel members encircling:

(a) said arch and instep portion, (b) the top of said leg encasing portion, (c) the ankle zone of said body member, and (d) spaced zones of said leg encasing portion, each of said band members being received in a separate one of said channels.

6. The overshoe of claim 5, wherein each of said band members is elastic.

7. The overshoe of claim 1, wherein said first reinforcement means comprises a separate sole member secured to said sole portion and said second reinforcement means comprises a separate heel member secured to said heel portion.

8. The overshoe of claim 7, wherein said sole member and said heel member are no greater than approximately $\frac{1}{8}$ inch (0.32 cm) thick, and are formed having ribbed surfaces.

9. The overshoe of claim 1, wherein said body member is made of fabric having a waterproof coating.

10. The overshoe of claim 1, wherein said collapsible body member is a substantially continuous waterproof sheet material.

11. The overshoe of claim 1, further comprising a storage pouch sized to receive a pair of said overshoes in a collapsed condition.

12. A protective overshoe comprising:

a body member formed of a collapsible waterproof sheet material, said body member having a leg encasing portion and a foot encasing portion;

said foot encasing portion having an instep portion, a heel portion, a sole portion and an arch portion, said heel and sole portions being separated by said arch portion;

a separate sole member and a separate heel member, said sole member being secured to said sole portion and said heel member being secured to said heel portion;

said sole member and said heel member being relatively non-collapsible compared to said body member, and being spaced from one another by said arch portion, said sole and heel members being foldable relative to each other by appropriately collapsing said arch and instep portions;

a first elastic member engaging and extending around said arch portion and said instep portion, said elastic member engaging said arch portion at a location spaced forwardly from the front edge of said heel member and being spaced rearwardly from the rear edge of said sole member, said band member providing adjustability across said arch and instep portions for various shoe sizes and shapes and for various heel heights;

a second elastic member encircling the top of said leg encasing portion to snugly support said collapsible body member on the leg of a wearer; and a third elastic member encircling the ankle zone of said collapsible body member to permit ready passage of the foot of the wearer to and from the foot encasing portion of said body member;

whereby said overshoe will accommodate a wide variety of shoe sizes and shapes and heel heights, and whereby said overshoe may be collapsed and folded to length and width dimensions only slightly greater than the length and width dimensions of said sole portion.

13. The overshoe of claim 12, further comprising a plurality of elastic members encircling the leg encasing portion of said collapsible body member to provide snug support for said leg encasing portion on the leg of the wearer, and to permit ready dressing and removal of the overshoe by the wearer.

14. The overshoe of claim 13, further comprising a plurality of channel members encircling:

(a) said arch and instep portion, (b) the top of said leg encasing portion, (c) the ankle zone of said body member, and (d) spaced zones of said leg encasing portion, each of said elastic members being received in a separate one of said channels.

15. The overshoe of claim 1, wherein said band member is elastic.

* * * * *